US007528648B2

(12) United States Patent
Raimar

(10) Patent No.: US 7,528,648 B2
(45) Date of Patent: May 5, 2009

(54) REPLICA BIASED SYSTEM

(75) Inventor: Nandakishore Raimar, Bangalore (IN)

(73) Assignee: Cypress Semiconductor Corporation, San Jose, CA (US)

( * ) Notice: Subject to any disclaimer, the term of this patent is extended or adjusted under 35 U.S.C. 154(b) by 0 days.

(21) Appl. No.: 11/709,990

(22) Filed: Feb. 22, 2007

(65) Prior Publication Data

US 2007/0210855 A1 Sep. 13, 2007

Related U.S. Application Data

(60) Provisional application No. 60/791,312, filed on Apr. 11, 2006.

(30) Foreign Application Priority Data

Feb. 23, 2006 (IN) ..... 294/CHE/2006

(51) Int. Cl.
*G05F 1/10* (2006.01)

(52) U.S. Cl. ..... 327/543

(58) Field of Classification Search ..... 327/530, 327/534, 535, 537, 538, 540, 543
See application file for complete search history.

(56) References Cited

U.S. PATENT DOCUMENTS 4,663,584 A * 5/1987 Okada et al. ..... 323/313
5,369,354 A * 11/1994 Mori ..... 323/313
5,652,539 A * 7/1997 Zanders et al. ..... 327/539
5,734,292 A * 3/1998 Shirai et al. ..... 327/541
5,869,997 A * 2/1999 Tomishima ..... 327/543
6,351,178 B1 * 2/2002 Ooishi et al. ..... 327/541
6,388,495 B1 * 5/2002 Roy et al. ..... 327/309
7,259,614 B1 * 8/2007 Baker et al. ..... 327/538

OTHER PUBLICATIONS

Gerrit W. den Besten and Bram Nauta, "Embedded 5 V-to-3.3 V Voltage Regulator for Supplying Digital IC's in 3.3 V CMOS Technology," IEEE Journal of Solid-State Circuits, vol. 33, No. 7, Jul. 7, 1998, pp. 956-962.

* cited by examiner

*Primary Examiner*—Jeffrey S Zweizig

(57) ABSTRACT

An apparatus, method and system are described for providing a low power replica biased regulated supply voltage without the size requirements of using a large resistor coupled between the source of a master transistor and ground. Instead, a source of a replica transistor diode may be biased with a bias voltage, and the gate and drain of the diode may be biased with a current bias. Additional descriptions provide the supply voltage without the size requirements of a resistor coupled between a source of one or more pass transistors and ground. Instead, the source of the pass transistor(s) may be biased with a "leaker" current.

19 Claims, 3 Drawing Sheets

REPLICA BIASED SYSTEM

RELATED APPLICATIONS

This application claims the benefit of U.S. Provisional Application Ser. No. 60/791,312, filed Apr. 11, 2006, entitled "Replica Biased Low Power I/O Regulator", which is hereby incorporated by reference. This application also claims the benefit of India Patent Application No. 294/CHE/2006, filed Feb. 23, 2006, entitled "Replica Biased Low Power I/O Regulator".

TECHNICAL FIELD

The present invention relates generally to voltage regulators and, more particularly to a replica biased low power voltage regulator.

BACKGROUND

A replica biased, n-channel metal-oxide-semiconductor field-effect transistor (n-channel MOSFET or NMOS) voltage regulator can be used to regulate the input/output (I/O) supply voltage to a designed value, for example 3 volts (V), to provide supply voltage to I/O circuitry, for example transistor logic circuits. For instance, a "replica" biased voltage regulator may implement one or more NMOS "pass" transistors which each replicate the voltage of a similar type NMOS replica transistor in a current sourcing type regulator. Each of the NMOS pass transistors and the replica transistor may be "similar" transistors, for example by being formed during the same or according to a similar manufacturing process (e.g., processing) and by having the same or substantially the same temperature effects (e.g., dependency) on the voltage drop between the gate and source with similar threshold voltage ($V_{TN}$) so that when their gates are biased with a same biasing voltage they supply a similar voltage at their source for a similar load (e.g., impedance or resistance).

In replica-biased architecture, a minimum load current is required through the replica NMOS and pass transistors to get accurate regulated voltage. This current can be called a "leaker" current. For instance, the master transistor must be biased to provide a stable output voltage at its source. Similarly, each replica pass transistor must be biased using the gate voltage of the pass transistor, so that its output voltage can settle down to a regulated voltage. The minimum amount of current required to flow through each pass transistor causes an additional power drain for the regulator which is proportional to the number of I/O supply voltages provided, for example for an equal number of I/Os used. For instance, an amount of extra power is required by the voltage regulator for each I/O, which is equal to the voltage provided, for example to be used by an I/O circuit driver, multiplied by the leaker current passing through the pass transistor.

FIG. 1 illustrates a conventional voltage regulator 100. Regulator 100 includes comparator 110 with charge pump 120 and master NMOS 140 in feedback (e.g., voltage Vrep at the source of NMOS 140) and it's source voltage is fed through a voltage divider to the inverted input IN 1 of comparator 110 and compared with bias voltage "bg" 112 which is provided at the non-inverting input IN 2. The output of comparator 110 is fed through inverter 160 to the gate of transistor 162. The drain of transistor 162 is fed by current mirror 170. Current mirror 170 includes similar transistor 172 and 174 each having their gate biased by current bias/source "ibg" 176. The drain of transistor 174 is also biased by ibg 176. The drain of transistor 172 is tied to the source of transistor 162. The drain of transistor 162 is tied to the gate of NMOS 140 and the current output of charge pump 120. Charge pump 120 is biased by ibg 122. A filter capacitor C 1 is in parallel between charge pump 120 and the gate of NMOS 140. The gate of NMOS 140 is coupled to the gates of NMOS pass or replica transistors 142, 144, 146, and 148. The sources of NMOS transistors 142 through 148 each supply an I/O supply voltage, for example to IO 152 (e.g., an I/O) through 158, respectively. Similarly, resistor R 3 is coupled between the source of each of pass transistors 142 through 148 and ground. Each of I/O 152 through 158 may be described as a transistor logic circuit such as a circuit including low voltage complementary MOSFET (LVCMOS) circuitry.

A bias voltage "bg" may represent a stable bias voltage as known in the industry, for example one provided by circuitry including a bandgap reference or like source. Also, "bg" may represent a stable and/or accurate reference voltage, for example a voltage of 1.2 V plus or minus 3-5 percent. Similarly, a bias current "ibg" may represent a stable bias current as known in the industry, for example one provided by circuitry including a bandgap reference. Also, "ibg" may represent a stable and/or accurate reference current, for example a current of I Amps plus or minus 7-10 percent.

The feedback structure of regulator 100 generates gate voltage VG to drive replica NMOS 140 as well as pass transistors 142 through 148. Each NMOS pass transistor is used to supply supply voltage Vout to each I/O. The "size" of each pass transistor is mainly determined by the input/output (I/O), high output current (IOH), high output voltage (VOH), and/or IOH/VOH specification of I/O. For instance, the "size" of a pass transistor or replica transistor may describe a number of discrete (e.g., single) transistors in parallel and the physical size (e.g., top perspective geographic area or space of a substrate, wafer or integrated circuit (IC) required for the transistor), electrical characteristics, range of $V_{TN}$, range of current flow of each such discrete transistors. A ratio of current may flow through the master transistor and each replica pass transistor to maintain each output voltage Vout at it's source (e.g., Vout equal to Vrep at the source of master NMOS 140). For example, the amount of current flowing through each pass transistor may be equal to 1 times, 2 times, 3 times, . . . another integer times the amount of current flowing through NMOS 140. This current ratio is determined by the "size" ratios of the replica transistor as compared to each master transistor. For example, with all other size factors equal, if the number of discrete transistors for a pass transistor is increased by tenfold (10×) then the pass transistor can deliver current tenfold (10×) of the master transistor with maintaining an output voltage of the master transistor equal to that of the pass transistor.

One problem with the voltage regulator of FIG. 1 is that as the DC current through each I/O (e.g., I/O 152 through 158) may be zero during operation, when the output of IO is settled (e.g., settles, such as by, after an initialization period after being powered on, reaching a stable level or substantially equal level over time) in its designed or desired high or low voltages, it is necessary to drain a minimum current (leaker current) through each pass transistor, other than using the IO's, to maintain a stable voltage output at the source of each pass transistor that is equal to Vrep. Specifically, as shown in FIG. 1, in order to have the same output that Vout compared to (e.g., having a ratio with) Vrep, a considerable value of "leaker" current is needed at ILeaker 15. It can be appreciated that ILeaker 15 may be divided and provided for each IO. As shown, the leaker current is equal to Vout/R 3 for each I/O. For the design of FIG. 1, R 3 is equal to "R/4", where "R" is the same resistance as that between the source of NMOS 140 and ground (e.g., R 1+R 2). Thus, ILeaker 15 is equal or in multiples to the current flowing out of the source of NMOS 140. The value of ILeaker 15 causes high currents, which drain or consume power. This power is inversely proportional to the size of "R". However, increasing resistance "R" to reduce current is very sensitive. For instance, use of a MOS based resistor for "R" cannot meet the accuracy requirements for the resistance of "R" required by the voltage regulator. Thus, for a substrate, wafer or IC based resistor, as resistance "R" increases, so does the amount silicon or physical size required for the resistor providing resistance "R". The physical size of R can be substantial and become a limiting factor in designing the voltage regulator in the form of area crunch or limit (e.g., there may be a predetermined maximum resistance for "R").

BRIEF DESCRIPTION OF DRAWINGS

The present invention is illustrated by way of example, and not by limitation, in the figures of the accompanying drawings in which.

DETAILED DESCRIPTION

Figure 1:
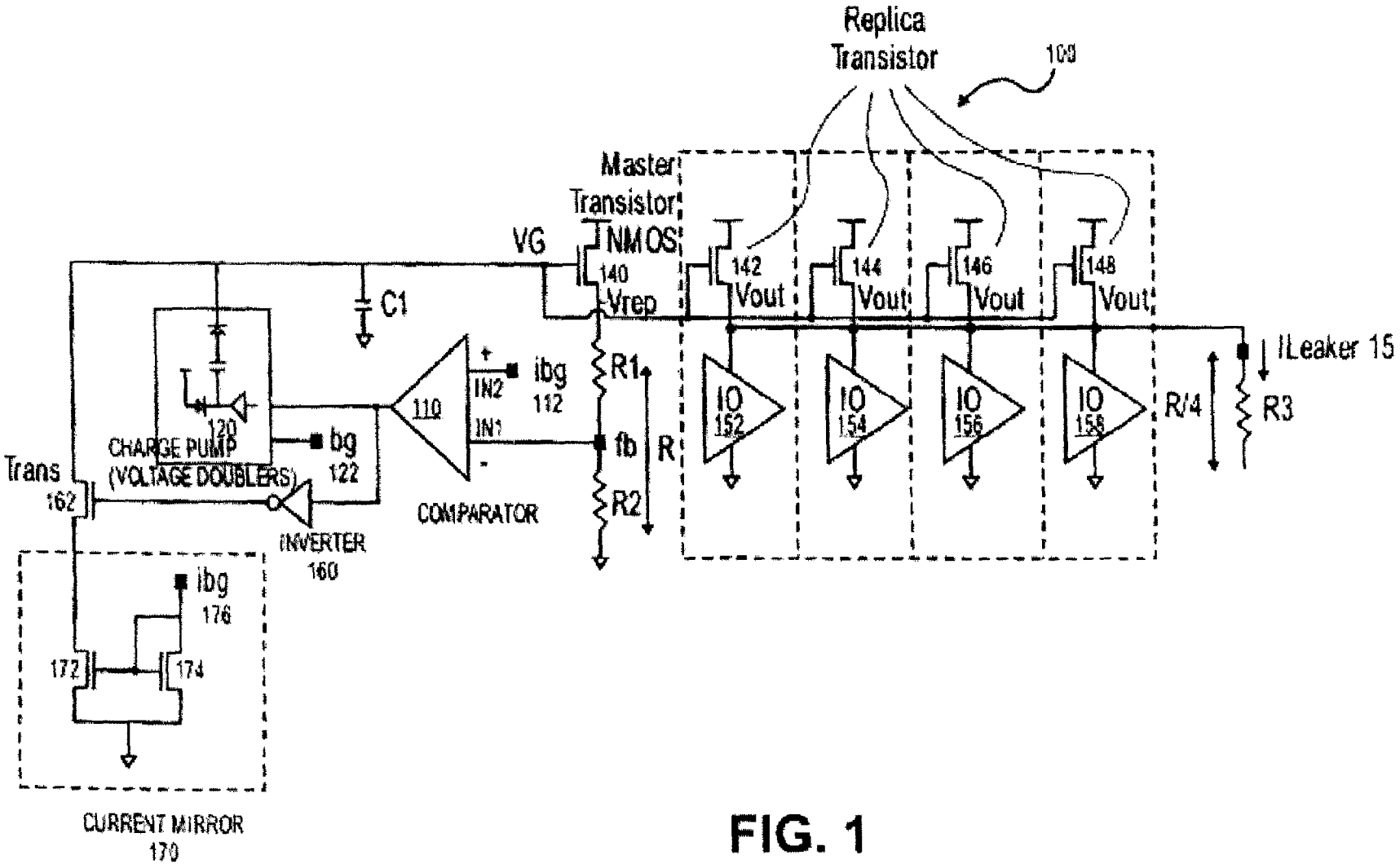
FIG. 1 PRIOR ART
FIG. 1 illustrates a conventional replica biased voltage regulator.

In the following description, for purposes of explanation, numerous specific details are set forth in order to provide a thorough understanding of the present invention. It will be evident, however, to one skilled in the art that the present invention may be practiced without these specific details. In other instances, well-known circuits, structures, and techniques are not shown in detail or are shown in block diagram form in order to avoid unnecessarily obscuring an understanding of this description.

Reference in the description to "one embodiment", "some embodiments", "embodiments" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment. Furthermore, the particular features, structures or characteristics may be combined as suitable in one or more embodiments of the invention. In addition, while the invention has been described in terms of several embodiments, those skilled in the art will recognize that the invention is not limited to the embodiments described. The embodiments of the invention can be practiced with modification and alteration within the scope of the appended claims. The specification and the drawings are thus to be regarded as illustrative instead of limiting on the invention.

The terms "circuit", "circuitry" and derivatives thereof as described herein may describe substrate, wafer or IC based electronic components such as resistors, capacitors, inductors, transistors, diodes, amplifiers, comparators, digital logic, bias references, clocks, and/or the like.

An apparatus, method and system are described for providing a low power replica biased regulated supply voltage (e.g., from a voltage regulator) without the size requirements of using a large resistor coupled between the source of a replica transistor and ground to supply the replica voltage. Instead, a source of a replica transistor diode may be biased with a bias voltage, and the gate and drain of the diode may be biased with a current bias. It can be appreciated that a voltage regulator according to such a design allows for a replica voltage to be provided by a smaller physically sized voltage regulator and current bias device combination, instead of from a current flowing through a larger resistor (e.g., "R") and thus may not require the size of that larger resistor for the design.

Additional descriptions provide the supply voltage without the size requirements of a resistor coupled between a source of one or more pass transistors and ground. Instead, the source of the pass transistor(s) may be biased with a "leaker" current. It can be appreciated that a voltage regulator according to such a design allows for a leaker current to be provided by a smaller physically sized current source, instead of a by a current flowing through a larger sized resistor (e.g., "R" divided by the number of pass transistors), and thus may not require the larger size of that resistor for the design.

Figure 2:
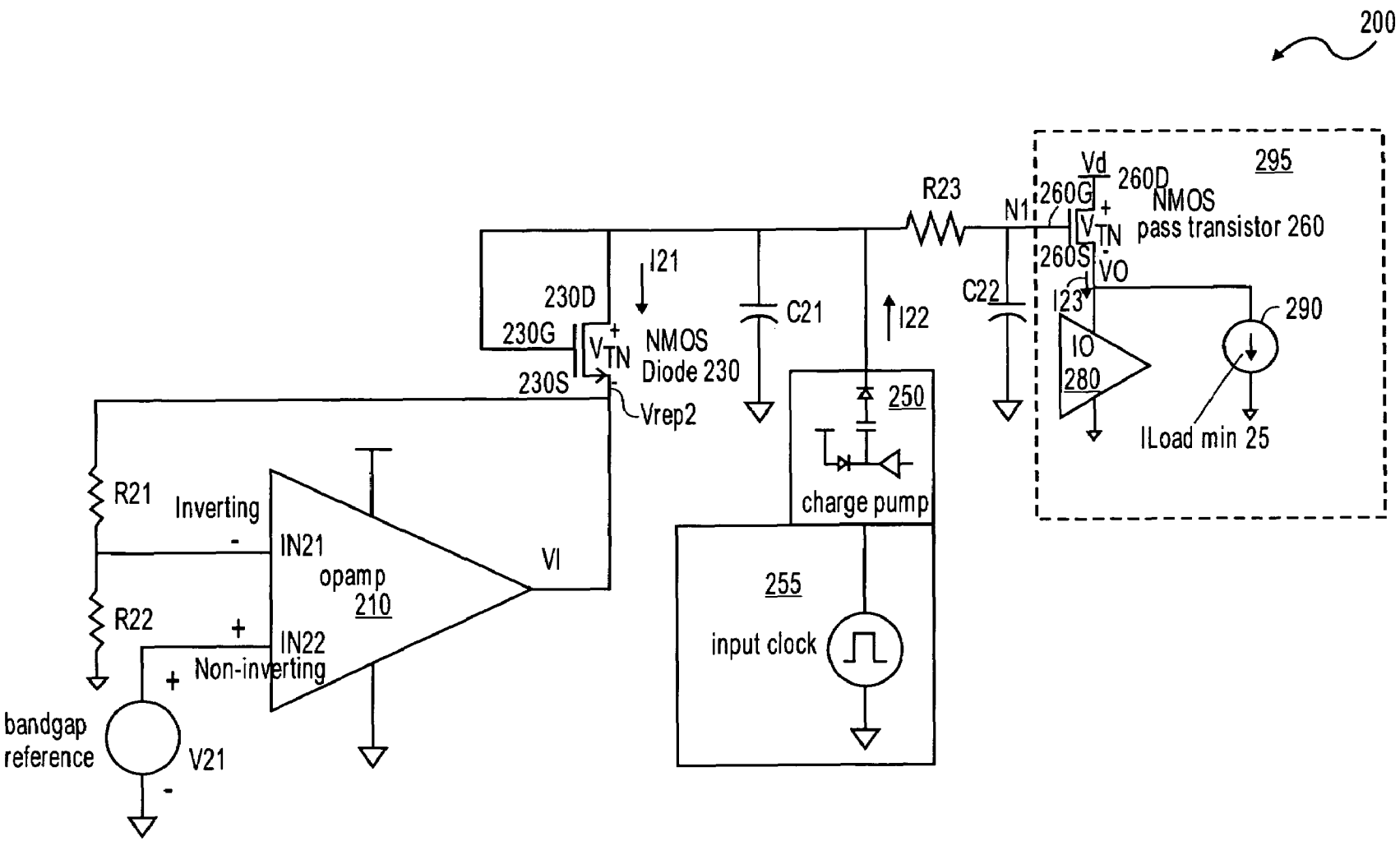
FIG. 2 illustrates one embodiment of a replica biased low power voltage regulator.

FIG. 2 illustrates one embodiment of a replica biased low power voltage regulator. FIG. 2 shows regulator 200 including operational amplifier 210 having inverting input IN 21 and non-inverting input IN 22, and voltage VI (e.g., an output voltage of the voltage generator and/or operational amplifier). Voltage VI may be described as a regulated voltage. Bandgap reference voltage V 21 is coupled to IN 22 and VI is coupled to IN 21 through a voltage divider (e.g., voltage VI is split based on resistance values of resistors R 21 and R 22). Specifically, resistor R 22 is coupled between input IN 21 and ground while resistor R 21 is coupled between input IN 21 and the output of amplifier 210 (e.g., voltage VI). Bandgap reference voltage V 21 may represent a stable bias voltage as known in the industry, for example one provided by circuitry including a bandgap reference or like source. Also, reference voltage V 21 may be described as a stable and/or accurate reference voltage, for example a voltage of 1.2 V plus or minus 3-5 percent. In some embodiments, amplifier 210, the voltage divider, and reference V 21 may be described as a voltage generator, for example a generator providing or supplying voltage $V_{rep2}$ to the source 230S of NMOS diode 230.

NMOS diode 230 is a NMOS transistor having its gate 230G tied to its drain 230D and its source 230S coupled to output of amplifier 210 (e.g., output voltage VI or $V_{rep2}$ of the voltage generator). Diode 230 may be described as and/or may perform a function similar to that of a master transistor (e.g., similar to that of NMOS transistor 140), and/or may provide a stable voltage at its source (e.g., $V_{rep2}$) to be replicated by one or more replica or pass transistors. Regulator 200 also includes charge pump 250 providing current I 22. Charge pump 250 may include input clock 255. The amount of current output by pump 250 may be defined by, related to, or proportional to the current bias to the charge pump. Pump 250 may be a current biasing device coupled to a drain and a gate of the transistor diode, where pump 250 is configured to apply a current bias to the drain of the transistor diode and bias the transistor diode (master transistor) just above the sub-threshold region of conduction for that transistor diode.

Charge pump 250 may be described as a voltage doubler/multiplier, current source or current drive coupled to the drain 230D of the NMOS diode and coupled to the gate 260G of NMOS pass transistor 260. Transistor 260 may be described as and/or may perform a function similar to that of a replica transistor (e.g., similar to that of transistor 142), and/or may provide or generate a stable supply voltage at its source (e.g., VO) to drive transistor logic. In some embodiments, a pass transistor 260 has gate 260G coupled to the gate and the drain of transistor diode 230, drain 260D coupled or connected to supply voltage Vd, and a source point used as output point at source 260S. Charge pump 250 may apply a current bias (e.g., a positive current) to the drain 230D of the diode. The gate 230G and drain 230D of diode 230 are coupled to the gate 260G of NMOS pass transistor 260. As the gate of transistor 260 consumes or passes substantially zero current, substantially all of current I 22 passes from the drain 230D to the source 230S of diode 230, as current I 21, forward biasing diode 230. Thus, when forward biased (e.g., current flowing from drain 230D to source 230S), diode 230 has voltage drop $V_{TN}$ between its drain 230D and source 230S. In some embodiments, current I 21 (and current I 22) may be between 2 and 3 micro (μ) Amperes ("amps" or A), or just enough current to forward bias (e.g., to minimally, slightly, or barely forward bias) the diode when voltage VI is 3 V or any designed regulating voltage. In some embodiments, $V_{TN}$ may be between 0.7 and 0.9 volts. In some embodiments, the voltage regulator supplying voltage $V_{rep2}$ may be described as including charge pump 250 (and clock 255).

Diode 230 may clamp the output of the voltage generator (e.g., which may try to increase to 4 V) to a maximum voltage VI equal to 3 V plus $V_{TN}$.

In some embodiments, the gate 230G and drain 230D of diode 230 are coupled to the gate 260G of NMOS pass transistor 260 through resistor R 23. Also, as the gate 260G of transistor 260 consumes or passes substantially zero current, the voltage drop across resistor R 23 may be zero or substantially zero, since very little current may pass through resistor R 23. In other embodiments, resistor R 23 may be optional and may be excluded from the design.

Regulator 200 is shown including capacitor C 21 coupled between the drain 230D of diode 230 and ground. Capacitor C 21 is coupled in parallel with pump 250. Capacitor C 21 with resistor R23 may function as a low pass filter, for example to filter out or reduce an amount of noise at or generated by the voltage generator (charge pump). In some embodiments, capacitor C 21 is optional, and may be excluded from the design.

Regulator 200 is also shown including resistor R 23 and capacitor C 22 which may form a low pass filter. Capacitor C 22 is coupled between the gate 260G of transistor 260 and ground. Capacitor C 22 and resistor R 23 are coupled in parallel with pump 250. The low pass filter formed by resistor R 23 and capacitor C 22 may filter out or reduce an amount of noise at or generated by the voltage regulator, diode, and/or charge pump 250 from reaching (e.g., from becoming a signal at) the gate 260G of transistor 260. In some embodiments, the low pass filter including resistor R 23 and capacitor C 22 are optional, and may be excluded from the design.

The drain 260D of transistor 260 may be coupled to unregulated supply Vd. Voltage Vd may be a voltage greater than or equal to $V_{rep2}$ plus few hundred milli-volts (mV) (for example 100 milli-volts). Gate 260G of the pass transistor may be biased to a voltage greater than or equal to $V_{rep2}$ plus $V_{TN}$ (e.g., 3.8V which is greater than 3.1V). The source 260S of transistor 260 may provide voltage VO as a supply voltage (e.g., an output voltage of the pass transistor or voltage regulator). In addition, the source 260S of transistor 260 may be coupled to input/output (I/O) circuit IO 280, for example to provide voltage VO as a supply voltage to IO 280. Circuit IO 280 may represent IO circuits, for example circuits including transistor circuits, logic circuits, digital logic circuits, and/or driver circuits (e.g., drivers for transistor and/or digital logic circuits).

Current I 23 is shown passing from the drain 260D to the source 260S of transistor 260, biasing the transistor. In some embodiments, current I 23 may be between 2 and 3 microamps (uA), or just enough current to forward bias (e.g., to minimally, slightly, or barely forward bias) the diode when voltage VO is 3 V. When biased, for example with current I 23, source 260S of the pass transistor 260 settles close to $V_{rep2}$ and it is almost or substantially independent of the voltage at drain 260D. In some embodiments, the voltage at source 260S may vary in a range of between 2.98V and 3.02V for a variation of voltage Vd at drain 260D in a range of between 3.2V and 5.25V (e.g., for a given leaker current load I23). The current I23 can be described as Iloadmin and can be implemented using a current source 290, which can be generated using a current mirror and an ibg (e.g., where ibg may be a stable bias current as known in the industry). According to embodiments, source 290 may be a current driver configured to apply a current bias to source 260S of the pass transistor to forward bias the pass transistor so that source of the pass transistor maintains the desired regulated voltage.

Moreover, for transistor diode 230 and transistor 260 having similar electrical characteristics (e.g., each being one or more transistors of the same transistor type and "size", but possibly having a different total sizes, etc. . . . as described below), regulator 200 provides voltage VO as a replica of voltage VI ($V_{rep2}$) when the gates and drains of transistor diode 230 and transistor 260 are biased as described above. Alternatively, during periods of time when I/O 280 is consuming current (e.g., for example to charge a capacitor of I/O 280), current I 23 may be greater than ILoadmin 25, and voltage VO may temporarily drop below voltage VI, for example to a voltage between 3 V and 0 V (e.g., drop by a typical value of for example, 200 milli-volts from or below the regulated voltage VO).

Consequently, according to embodiments, the voltage regulator, diode, charge pump and pass transistor generate voltage VO which replicates (e.g., is driven or caused by the voltage regulator and/or pass transistor to equal or substantially equal) voltage $V_{rep2}$. For instance, the transistor of diode 230 and transistor 260 may include on or more transistors which have the same dimension, electrical characteristics, and/or size (e.g., the "size" of a transistor may refer to its dimension, physical size, and/or maximum output current capability). In some embodiments, each replica transistor may have a "total size" which is a multiple of the total size of diode 230. For instance, the replica transistors may generally be several times (e.g., 1, 2, 4, 8, 10, a multiple thereof, a combination thereof, or a multiple of a combination thereof) bigger (e.g., greater in total "size" and/or output current capability) than the master transistor (e.g., than the total size of diode 230).

Also, a ratio of current may flow through diode 230 (e.g., current I 21) and pass transistor 260 (e.g., current I 23) to maintain voltage VO equal or substantially equal to voltage $V_{rep2}$. For example, current I 23 may be equal to or substantially equal to 1 times, 2 times, 3 times, . . . another integer times the amount of current I 21. This current ratio is determined by the "size" ratios of the transistor of diode 230 as compared to transistor 260. For example, with all other size factors equal, if the number of discrete transistors for transistor 260 is increased tenfold, thus increasing current I 23 tenfold, then current I 21 will have to be increased tenfold to maintain voltage $V_{rep2}$ equal to what it was before the increase of I 23. Hence, any or all of the terms, "current sourcing replica based type regulator" may be applied to regulator 200. In addition, as described herein, regulator 200 may consume or require less current or power than other regulator designs and thus, the terms "low power" may also be applied to regulator 200. Likewise, regulator 200 may be described as a current driven and/or voltage driven regulator driven by the voltage b the terms "low power" may also be applied ias of the gate and drain of diode 230, driven by the voltage bias of the gate of pass trans 260, and/or with a minimum unregulated supply voltage Vd (e.g., where Vd is greater than the regulated voltage, $V_{rep2}$ plus 100 milli-volts).

For instance, diode 230 may represent a number of discrete transistors in parallel (e.g., each having their gates tied together, sources tied together, and drains tied together) and each having a same or equal "size". In some embodiments, diode 230 may represent 4 transistors in parallel, where each transistor has a width of 28 microns and a length of 0.55 microns (a micron is 10E-6 meters). Similarly, transistor 260 may also represent a number of discrete transistors in parallel and each having a same or equal "size". In some embodiments, transistor 260 may represent 26 transistors in parallel, where each transistor has a width of 28 microns and a length of 0.55 microns (a micron is 1E-6 meters).

It can be appreciated that transistor 260 may represent more than one transistor similar to transistor 260 coupled to node N1 to provide more output voltages similar to VO. The voltage at node N1 may be equal or substantially equal to the voltage at the drain 230D of diode 230. In some embodiments, the additional transistors may be biased similar (e.g., using and ILoadmin 25) to so that the output of the pass transistor (260S) settles to a voltage equal to the voltage at source 230S of diode 230 (e.g., equal to the output of diode 230) as described above for transistor 260. Similarly, stage 295 may represent one or more of such stages. For example, one or more stages similar to stage 295 may be coupled at node N1 to regulator 200.

Various values and ranges are contemplated for the voltages, currents, resistors, capacitors, transistors, other electronic devices, and/or other signals described herein for embodiments of the voltage regulators. For instance, according to some embodiments, voltage VI (e.g., voltage $V_{rep2}$) may be 3 volts, and voltage VO may be 3 volts as well. Moreover, according to embodiments, current I 21 may be between 2 and 3 micro-amps. In some embodiments, ILoadmin 25 (e.g., current bias of source 290) may be approximately multiples of 2 to 3 micro-amps (based on ratio size of pass transistor/size of master transistor). For example, using band gap reference voltage V 21, 3 volts may be generated by amplifier 210 with the non-inverting amplifier configuration shown. Also, with NMOS transistor diode 230 stacked on the output of amplifier 210, charge pump 250 may force a small current (e.g., 2-3 micro-amps) on the NMOS diode drain 230D and gate 230G in such a way that the NMOS diode gets slightly forward biased (operating just out of sub-threshold region). Consequently, the voltage at node N1 (e.g., the gate of transistor 260) is used to bias transistor 260. Moreover, current source 290 may also be used to bias transistor 260 to keep the source 260S of transistor 260 at 3 volts. Thus, the source 260S of transistor 260 may be used as a regulated supply voltage for I/O 280. I/O 280 may be used to provide supply voltage to transistor logic. In some embodiments, the voltage at the drain 230D of diode 230 and gate 230G, and/or gate of 260G may be between 3V+ a maximum threshold voltage of NMOS diode 230 (or NMOS transistor 260) and 3V+ a minimum threshold voltage of NMOS diode 230 (or NMOS transistor 260). The typical value of threshold voltage of NMOS diode 230 (or NMOS transistor 260) can vary from a minimum of 0.4V to a maximum of 0.8V. The voltage at any or all of drain 230D of diode 230 and gate 230G, and/or gate of 260G may be equal for a period of time, but not equal over another period of time (e.g., before or after the first period).

In addition, according to embodiments, regulator 200 may be designed with resistor R 21 having a value of 101K Ohms (Ω) and R 22 having a value of 77.6K Ohms. Reference voltage V 21 may be between 1.2 and 1.3 volts, for example by being 1.2 volts. Clock 255 may have a frequency of between 6 Mega-Hertz (MHz) and 12 MHz. When present, optional capacitor C 21 may be 1-2, and C 22 may be 5 pico-Farads (pF). Likewise, when present, optional resistor R 23 may have a value of 4K Ohms.

In addition to considering various values and ranges for the voltages, currents, and/or electronic devices described herein, it is considered that the voltage regulator (e.g., voltage bias voltage VI), charge pump (e.g., current bias I 22), low pass filters, and current source (e.g., current bias ILoadmin 25) may include or be implemented by circuitry different that than shown in FIG. 2. For instance, some or all of the circuitry shown in FIG. 2 for the voltage regulator, charge pump, low pass filters, and/or current source may be different, for example by using other circuits having the same function, as know in the art.

Figure 3:
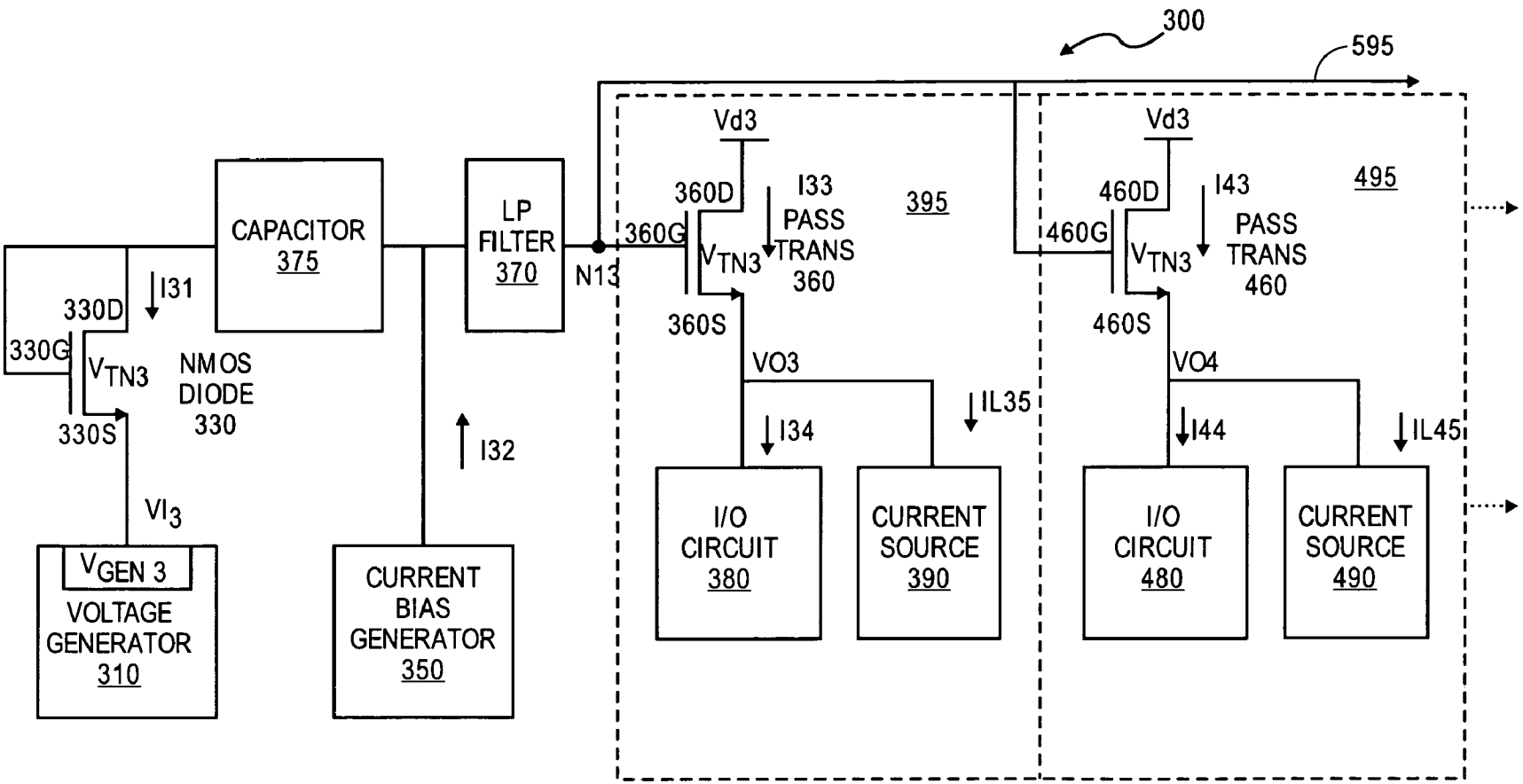
FIG. 3 illustrates one embodiment of a replica biased low power voltage regulator.

For example, FIG. 3 illustrates one embodiment of a replica biased low power voltage regulator. FIG. 3 shows regulator 300 including voltage generator 310 coupled to the source 330S of NMOS diode 330. Diode 330 may be described as and/or may perform a function similar to that of a master transistor (e.g., similar to that of NMOS transistor 140 and/or diode 230), and/or may provide a stable voltage at its source (e.g., $VI_3$) to be replicated by one or more replica or pass transistors. FIG. 3 shows the output of voltage generator 310 as $V_{GEN3}$, which provides voltage bias $VI_3$ as the replica voltage to the source 330S of diode 330. Current bias generator 350 is coupled to the gate 330G and drain 330D of diode 330 through capacitor 375. Generator 350 is also coupled to the gate 360G of pass transistor 360 through low pass filter 370. Transistor 360 may be described as and/or may perform a function similar to that of a replica transistor (e.g., similar to that of transistor 142 or 260), and/or may provide or generate a stable supply voltage at its source (e.g., VO3) to drive transistor logic. In some embodiments, a pass transistor 360 has gate 360G coupled to the gate and the drain of transistor diode 330, drain 360D coupled or connected to supply voltage Vd3 (e.g., an unregulated supply voltage), and a source point used as output point at source 360S. Bias generator 350 provides current bias I 32 to the drain 330D and gate 330G of diode 330. Generator 350 may be a current biasing device coupled to a drain and a gate of the transistor diode, where generator 350 is configured to apply a current bias to the drain of the transistor diode and bias the transistor diode (master transistor) just above the sub-threshold region of conduction for that transistor diode. Current bias I 32 may be substantially similar to current I 31 flowing through diode 330. When forward biased, diode 330 has voltage drop $V_{TN3}$ between its source 330S and drain 330D. Current bias I 31 may be provided to the gate 330G and/or drain 330D of diode 330 by generator 350, for example to barely or minimally forward bias diode 330. In alternate embodiments, bias generator 350 may be coupled to the gate 330G and drain 330D of diode 330 to provide a bias voltage at the drain of diode 330 equal to $VI_3$ plus $V_{TN3}$.

In some embodiments, filter 370 and/or capacitor 375 may be optional and may be excluded.

FIG. 3 also shows voltage supply output stages 395 and 495 coupled to node N13 at the output of low pass filter 370. The gate of transistors 360 and 460 are coupled to node N13, generator 350, the drain 330D and source 330S of diode 330, and optionally to filter 370 and or capacitor 375. The voltage at node N13 may be equal or substantially equal to the voltage at the drain 330D of diode 330.

Stage 395 includes pass transistor 360 having current I 33 flowing from its drain 360D to source 360S and voltage $VO_3$ as a regulated supply output voltage at its source 360S. When biased, transistor 360 has voltage of $VI_3$ at its source 360S almost independent of drain voltage 360D (the drain voltage may be more than regulated voltage by few hundred milli-volts). The drain 360D of transistor 360 may be coupled to an unregulated supply voltage $Vd_3$. The source 360S of transistor 360 is also coupled to I/O circuit 380 and current source 390. Current I 34 is shown flowing into circuit 380. Current bias IL 35 is provided to the source 360S of transistor 360 by current source 390, for example keeping transistor barely in a saturation region (close to sub threshold). According to embodiments, source 390 may be a current driver configured to apply a current bias to source 360S of the pass transistor to forward bias the pass transistor so that source of the pass transistor maintains the desired regulated voltage.

Stage 495 is shown having pass transistor 460, I/O circuit 480, and current source 490 in a configuration or coupled together similar to the corresponding components of stage 395. The components of stage 495 may have similar size, bias, and/or electronic characteristics as those of stage 395. Specifically, transistor 460 may have the same size, etc. as transistor 360. For example, transistor 460 may be biased by IL 45 at source 460S, and $Vd_3$ at drain 460D, to have voltage of $VI_3$ at its source 460S.

It is also considered that one or more additional stages, similar to and in addition to stage 395, may be part of regulator 300. These additional stages may be coupled to node N13 at coupling 595, similar to the coupling of stage 495 to node N13.

Regulator 300 may or may not be a regulator having similar components and/or functionality as regulator 200. For example, the same terms that apply to or define regulator 200 may also apply to or define regulator 300. Thus, voltage generator 310 may be a generator similar to that described for the voltage generator of FIG. 2, or may include other circuitry to provide bias voltage $VI_3$.

Moreover, diode 330 and/or transistor 360 may be similar to (e.g., have similar electrical characteristics) diode 230 and/or transistor 260, respectively, of FIG. 2, or may include other circuitry to provide the functionality of a transistor diode and/or a pass transistor (e.g., a diode and pass transistor having characteristics matched as noted herein). For example, in some embodiments, voltage $V_{TN3}$ may be equal to a voltage similar to that of voltage $V_{TN}$ of FIG. 2, or may be another voltage drop different than voltage $V_{TN}$. Likewise, filter 370 and/or capacitor 375 may be similar to the corresponding low pass filters of FIG. 2 (e.g., capacitor C 21 for filter 370, and/or resistor R 23 and capacitor 22 for capacitor 375), or may include other circuitry to provide low pass filtering, for example to reduce noise at node N13 from other devices. Also, generator 350 may include circuitry similar to that described for clock 255 and/or pump 250, or may include other circuitry to provide current bias I 32.

Also, current source 390 (source 490, . . . etc.) may include circuitry described for source 290, or other circuitry to provide current bias IL 35. Next, I/O circuit 380 (I/O circuit 480, . . . etc.) may include circuitry described for I/O circuit 280, or other circuitry.

Moreover, diode 330 may be transistor diode similar to that described for transistor diode 230 of FIG. 2. Similarly, transistor 360 (transistor 460, . . . etc) may be a transistor similar to that described for transistor 260 of FIG. 2, to provide output voltage $VO_3$ (e.g., at the source 360S of transistor 360) equal or substantially equal to voltage at 360$G_3$ minus $V_{TN3}$.

Thus, the design of regulator 300 allows for various currents, voltages and circuitry as compared to regulator 202. Accordingly, regulator 300 may provide $VI_3$ (and $VO_3$ may be equal to $VI_3$) a voltage greater than or less than 3 V, for example by being, for example, 0.5, 1, 2, 4, 4.5, 5, 7.5, or 10 V. Alternatively, regulator 300 may provide other voltages. Likewise, in some embodiments, voltage $Vd_3$ may be equal to a voltage greater than VO3/VO4 plus few hundred milli-volts. Also, generator 350 may provide current I 32 that is greater than or less than 2-3 micro-Amps, by being, for example, 0.5, 1, 4, 4.5, or 5 micro-Amps. Next, source 390 may provide current IL 35 that is greater than or less than 2 micro-Amps, for example by being, for example, 0.5, 1, 3, 4, 4.5, or 5 micro-Amps (multiplied by an integer ratio (e.g., an integer multiple of I 31), where the integer rations is equal to or based on the size of pass transistor as compared to the size of transistor 330, as described above for current I 23 as compared to current I 21).

In other embodiments, the biasing currents or voltages described herein may be supplied by a bias voltage or current, respectively. For example, a bias current (e.g., a current bias) may be supplied by a current in series with bias voltage (e.g., a voltage bias) applied across an impedance or resistance. Similarly, a bias voltage may be supplied by a voltage in parallel with bias current applied across an impedance or resistance.

One advantage of the replica biased voltage regulators described herein is that the minimum load current (e.g., ILoadmin 25) at the source of an NMOS pass transistor at each I/O can be reduced significantly (e.g., by more than 25 or 80%) and the minimum load current can be independent of the output of the voltage divider (e.g., voltage generator). Hence, power consumption by the regulator or a chip or substrate the regulator is on, can be reduced. In addition, the size or area that the regulator requires or takes up on the chip or substrate can be reduced, due to the use of current biasing instead of voltage across resistors coupled to the output of a bias transistor and/or pass transistor(s). Thus, the replica biased voltage regulators described herein may result in or be described as low power I/O regulators with low overhead (e.g., low die area overhead) as compared to other regulators (e.g., see FIG. 1). Such low power, low overhead regulators may be beneficial for low power (e.g., desiring to minimize power consumption) and/or low overhead (e.g., desiring to minimize area consumption) applications for example programmable systems on a chip.

Also, use of an NMOS diode provides an advantage of being a current driven device, for example to be minimally or slightly forward biased by a current applied to its drain. Similarly, use of an NMOS pass transistor provides an advantage of being a current driven device, for example to be minimally or slightly biased by a current (transistor operating in saturation but close to sub threshold region) applied to its source.

However, although embodiments of the invention have been illustrated using NMOS technology for ease of discussion, in alternative embodiments, the concepts above may be applied using other device types and process technologies. For example, PMOS or CMOS technology may be used in place of one or more of the NMOS transistors described. Also, it is noted that the circuits described herein may be designed using various voltages, currents, and/or electrical characteristics.

Although the present invention has been described with reference to specific embodiments (e.g., "exemplary" embodiments), it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed, is:

1. An apparatus comprising:

a voltage generator coupled to a source of a transistor diode, the voltage generator configured to apply a bias voltage to the source of the transistor diode, wherein the voltage generator comprises an operational amplifier having an output coupled to the source of the transistor diode, a non-inverted input coupled to a band gap reference voltage source, and an inverted input coupled to the output of the operational amplifier through a voltage divider;

a current biasing device coupled to a drain and a gate of the transistor diode, the biasing device configured to apply a current bias to the drain of the transistor diode; and a pass transistor having a gate coupled to the gate and the drain of the transistor diode, wherein an output voltage at the source of the pass transistor is approximately equal to the bias voltage.

2. The apparatus of claim 1, wherein the transistor diode comprises an NMOS transistor having a drain and a gate, wherein the drain is coupled to the gate, wherein the current biasing device is further configured to bias the transistor diode above a sub-threshold region of conduction of the transistor diode, and wherein the pass transistor has a drain and a source point, the drain coupled to a supply voltage and the source point used as an output point.

3. The apparatus of claim 2, wherein the current bias is a first current bias to forward bias the transistor diode; and further comprising a current driver coupled to the source of the pass transistor, the current driver configured to apply a second current bias to the source of the pass transistor to bias the pass transistor so that the source of the pass transistor maintains a desired regulated voltage.

4. The apparatus of claim 3, wherein the pass transistor comprises an NMOS transistor having a gate coupled to the gate of the transistor diode, and wherein a voltage at the source of the transistor diode is approximately equal to the voltage at the source of the pass transistor.

5. The apparatus of claim 4, wherein the bias voltage is a first bias voltage, wherein the NMOS transistor diode comprises a number of a size and a type of transistors, wherein the NMOS pass transistor is the number multiplied by an integer greater than one of the same size and the same type of transistors; and further comprising a second bias voltage coupled to a drain of the pass transistor.

6. The apparatus of claim 1, further comprising a low pass filter coupled between the drain and the gate of the transistor diode and the gate of the pass transistor.

7. The apparatus of claim 1, wherein the current biasing device comprises one of a charge pump and a current source.

8. The apparatus of claim 7, wherein the current biasing device is configured to apply a biasing current in a range of between approximately 2 to 3 micro-amperes (uA) to the drain of the transistor diode.

9. The apparatus of claim 7, wherein the current biasing device is configured to apply a sufficient current bias to the drain of the transistor diode to cause a voltage drop of a threshold voltage of the transistor diode between the source and drain of the transistor diode.

10. The apparatus of claim 1, wherein the bias voltage comprises an approximately constant voltage level of 3 volts and the output voltage changes to replicate the voltage bias voltage.

11. The apparatus of claim 3, further comprising a plurality of additional pass transistors and a plurality of additional current drivers coupled to a source of each additional pass transistor, wherein each of the pass transistors has a gate coupled to the gate of the pass transistor.

12. The apparatus of claim 3, further comprising:

a plurality of additional pass transistors;

a plurality of additional current drivers coupled to a source of each additional pass transistor; and a plurality of additional input/output (I/O) circuits coupled to the source of each additional pass transistor.

13. A replica biased system comprising:

a current bias generator configured to bias a gate and a drain of a diode transistor and to bias a plurality of gates of a plurality of pass transistors;

a plurality of current drivers, each of the plurality of current drivers configured to bias a source of each of the plurality of pass transistors; and a voltage generator configured to bias a source of the diode transistor with a bias voltage, wherein the voltage generator comprises an operational amplifier having an output coupled to the source of the transistor diode, a non-inverted input coupled to a band gap reference voltage source, and an inverted input coupled to the output of the operational amplifier through a voltage divider.

14. The system of claim 13, wherein a supply voltage to be generated at the source of each of the plurality of pass transistors is approximately equal to the bias voltage.

15. The system of claim 13, further comprising a plurality of transistor logic circuits, each of the plurality of transistor logic circuits coupled to the source of each of the plurality of pass transistors.

16. A method of replicating a supply voltage comprising:

biasing a source of a diode transistor with a bias voltage, wherein the bias voltage is generated by a voltage generator, the voltage generator comprising an operational amplifier having an output coupled to the source of the transistor diode, a non-inverted input coupled to a band gap reference voltage source, and an inverted input coupled to the output of the operational amplifier through a voltage divider;

biasing a drain and a gate of the diode transistor with a first bias current;

biasing a source of each of a plurality of pass transistors with a plurality of second bias currents, wherein a gate of each of the plurality of pass transistors is coupled to the gate of the diode transistor; and providing a plurality of supply voltages at the source of each of the plurality of pass transistors.

17. The method of claim 16, wherein each of the plurality of supply voltages changes to become approximately equal to the bias voltage.

18. The method of claim 16, further comprising providing each of the plurality of supply voltages to one of a plurality of transistor logic circuits.

19. The method of claim 16, further comprising:

forward biasing the transistor diode with approximately 5 microamperes of current using the bias voltage applied to the source of the transistor diode and the first current bias applied to a gate and a drain of the transistor diode; and forward biasing each of the plurality of pass transistors with a current level that is a multiple of the first bias current using the plurality of second bias currents and a voltage at the gate of the transistor diode applied to a gate of each of the plurality of pass transistors.

* * * * *